US008362377B2

(12) United States Patent
Wei et al.

(10) Patent No.: US 8,362,377 B2
(45) Date of Patent: Jan. 29, 2013

(54) CONTROL KEY ASSEMBLY FOR ELECTRONIC DEVICE

(75) Inventors: Xiao-Liang Wei, Shenzhen (CN); Zhi-Yun Shen, Shenzhen (CN)

(73) Assignees: Shenzhen Futaihong Precision Industry Co., Ltd., Shenzhen (CN); FIH (Hong Kong) Limited, Kowloon (HK)

( * ) Notice: Subject to any disclaimer, the term of this patent is extended or adjusted under 35 U.S.C. 154(b) by 476 days.

(21) Appl. No.: 12/728,343

(22) Filed: Mar. 22, 2010

(65) Prior Publication Data

US 2011/0042193 A1 Feb. 24, 2011

(30) Foreign Application Priority Data

Aug. 24, 2009 (CN) ..... 2009 1 0305995

(51) Int. Cl.
*H01H 3/00* (2006.01)

(52) U.S. Cl. ..... 200/329

(58) Field of Classification Search ..... 200/537, 200/547–551, 296, 329–331, 17 R, 43.04, 200/338; 361/679.01, 679.09
See application file for complete search history.

(56) References Cited

U.S. PATENT DOCUMENTS 5,465,191 A * 11/1995 Nomura et al. ..... 361/679.27
7,164,578 B2 * 1/2007 Wang et al. ..... 361/679.08
7,385,809 B2 * 6/2008 Graffius ..... 361/679.55

* cited by examiner

*Primary Examiner* — Edwin A. Leon
(74) *Attorney, Agent, or Firm* — Altis Law Group, Inc.

(57) ABSTRACT

A control key assembly for an electronic device includes a housing and a control key. The housing forms a receiving portion defining an opening having two spaced-apart arms. The control key is received in the receiving portion. The control key includes a first hook and a second hook. The first hook and the second hook are slidably engaged in the opening, and alternatively latch with the two arms when the control key is slid between first and second positions.

14 Claims, 6 Drawing Sheets

CONTROL KEY ASSEMBLY FOR ELECTRONIC DEVICE

BACKGROUND

1. Technical Field

The present disclosure relates to control key assemblies, particularly to a control key assembly used in a portable electronic device.

2. Description of Related Art

Many portable electronic devices, such as mobile phones, have a housing defining an interior compartment for receiving a printed circuit board (PCB). The devices often include a control key assembly on one side of the housing, allowing one-handed operation of the device.

Typically, the control key assembly is loosely located in a space defined in an outer shell of the portable electronic device, with a slight gap defined between the control key assembly and the outer shell. The control key moves easily in the opening, and may, under more serious forces, physically separate from the rest of the assembly.

Therefore, there is room for improvement within the art.

BRIEF DESCRIPTION OF THE DRAWINGS

Many aspects of the disclosed control key assembly can be better understood with reference to the following drawings. The components in the drawings are not necessarily drawn to scale, the emphasis instead being placed upon clearly illustrating the principles of the present control key assembly, in which.

DETAILED DESCRIPTION

The disclosed control key assembly may be applied in portable electronic devices such as mobile phones or personal digital assistants (PDA) in accordance with an exemplary embodiment. In the exemplary embodiment, the control key assembly used in a mobile phone is illustrated, although the disclosure is not limited thereto.

Figure 1:
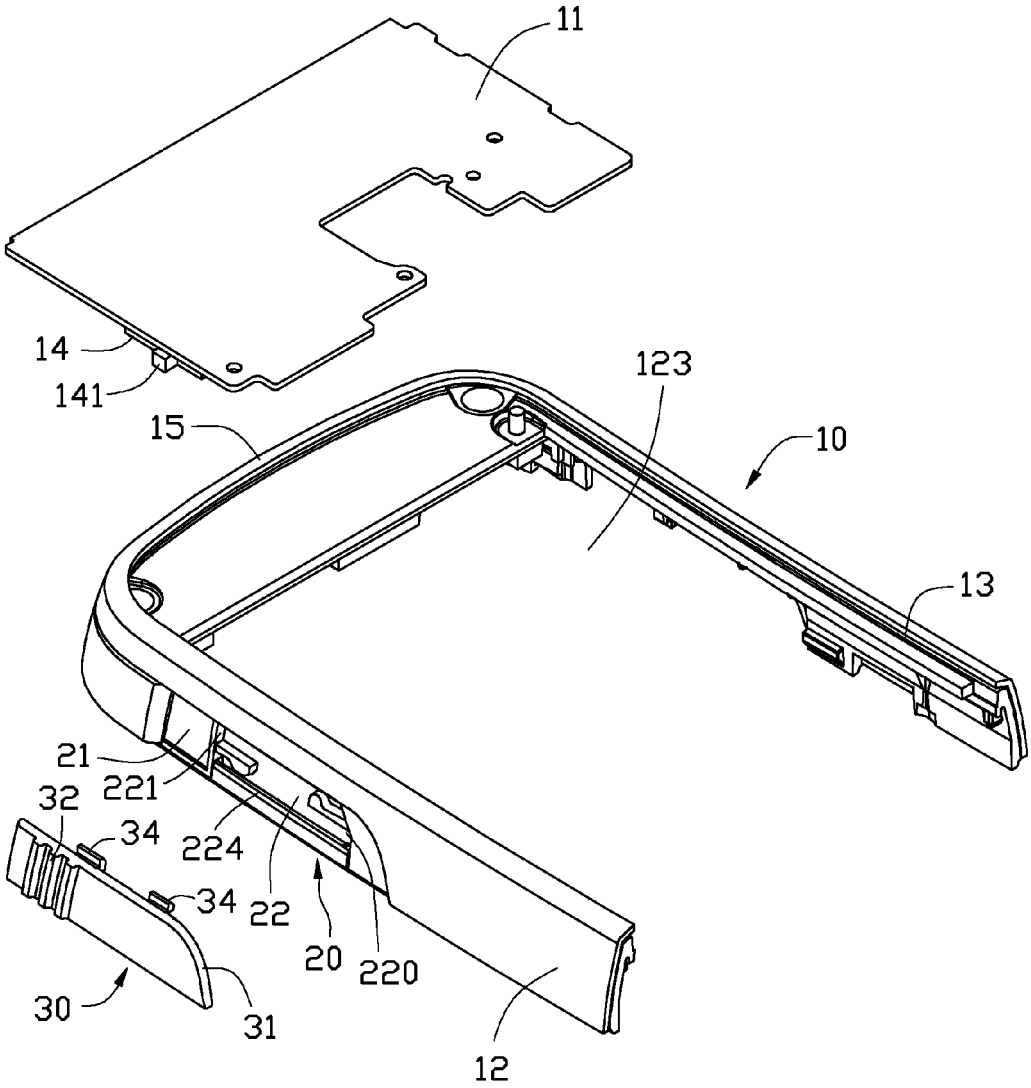
FIG. 1 is an exploded view of a portion of a portable electronic device using a control key assembly in accordance with an exemplary embodiment.
Figure 2:
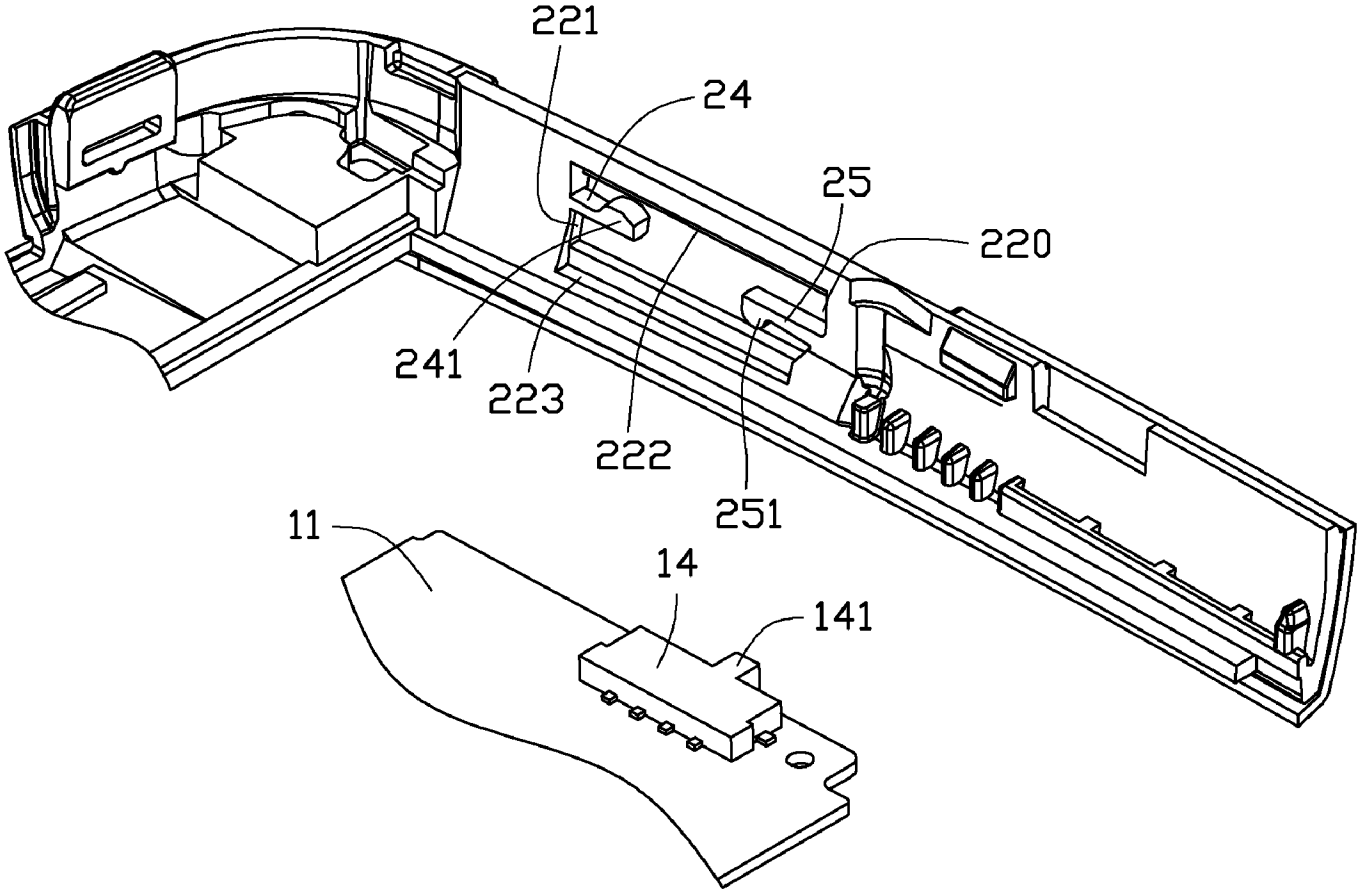
FIG. 2 is an isometric view of the housing and the printed circuited board of FIG. 1, but showing another aspect thereof.
Figure 3:
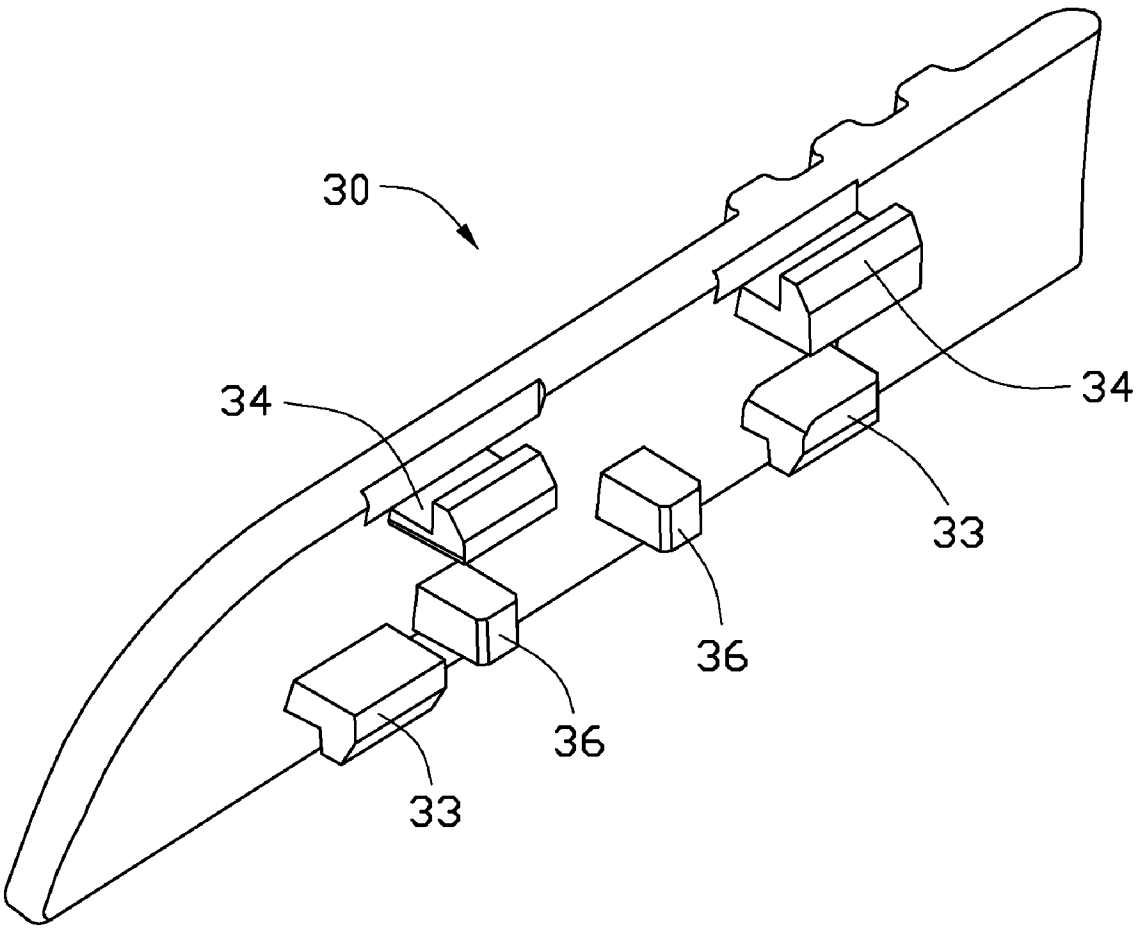
FIG. 3 is an enlarged view of the control key in FIG. 1 from another aspect.

FIG. 1 shows a portable electronic device 200 (only a portion of which is shown) including a housing 10, a printed circuited board (PCB) 11, and a control key 30.

The housing 10 includes a first sidewall 12, a second sidewall 13, and an end wall 15. The first, second sidewalls 12, 13 and the end wall 15 are connected to each other, and define a cavity 123. The first sidewall 12 forms a receiving portion 20. The receiving portion 20 defines a groove 21 for slidably receiving the control key 30. A rectangular opening 22 is defined in a bottom surface of the groove 21, and communicates with the first sidewall 12. Two stopper plates 220, 221 and two latching plates 222, 223 are formed around the opening 22. The latching plates 222, 223 are stepped, and each has a thinner rib 224. Two spaced-apart opposite arms 24, 25 respectively extend into the opening 22 from the stopper plates 220, 221. A first projection 241 extends in a first direction from the arm 24 and a second projection 251 extends in a second, opposite direction from the arm 25.

The PCB 11 is received in the cavity 123 of the housing 10. A multi-position switch 14 is disposed on the PCB 11. The switch 14 has a button 141.

The control key 30 includes a main portion 31 and an operating portion 32. The main portion 31 is slidably received in the groove 21. The operating portion 32 is integrally formed with the main portion 31. A set of first hooks 33 and a set of second hooks 34 are formed at an inner surface of the main portion 31. The first hooks 33 are coaxial and are positioned adjacent to an edge of the control key 30. The second hooks 34 are coaxial, and are positioned adjacent to another edge of the control key 30 opposite to the first hooks 33. A set of blocks 36, e.g., two blocks, are positioned between the first hooks 33.

Figure 4:
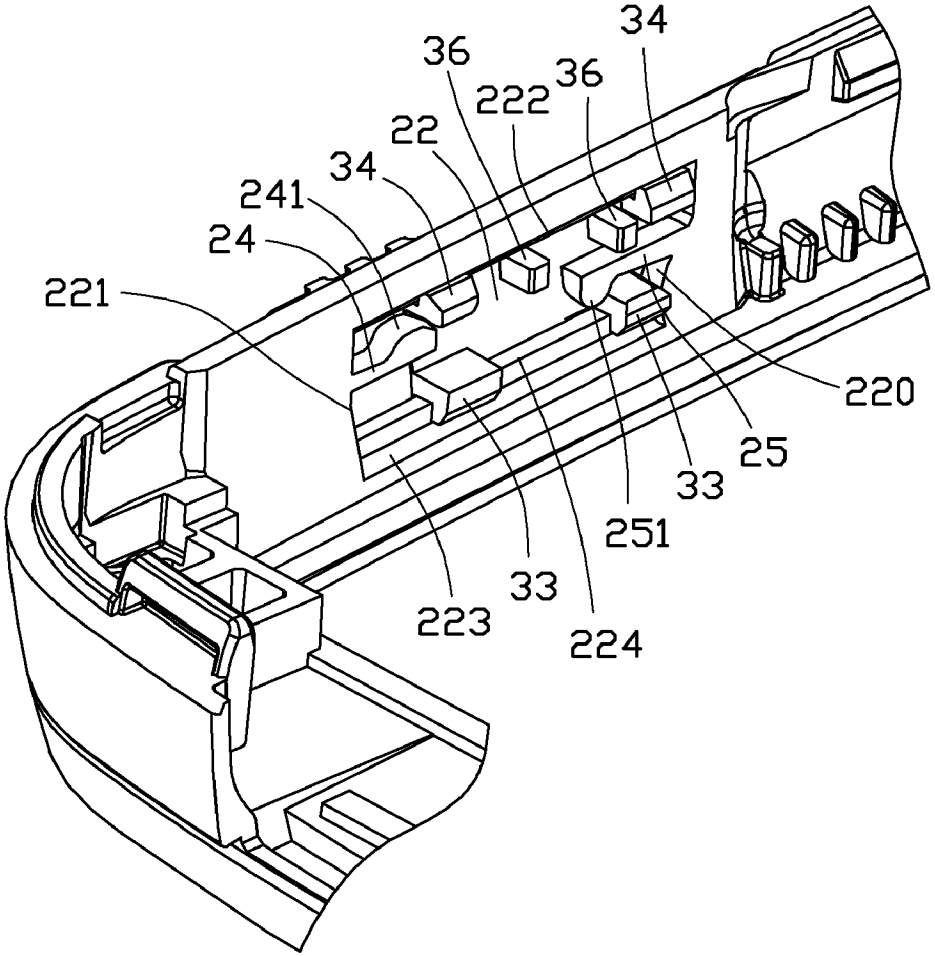
FIG. 4 is a partially assembled view of the control key attached to the housing.

Referring to FIG. 4, during assembly, the control key 30 is received in the groove 21 of the housing 10. The first hooks 33 extend through the opening 22 to allow the first hooks 33 to latch with the latching plates 223. The second hooks 34 extend through the opening 22 to allow the second hooks 34 to latch with the latching plates 222. The second projection 251 latches with one of the second hooks 34. The blocks 36 are received in the opening 22, and allow the switch 14 to be positioned between the blocks 36.

Figure 5:
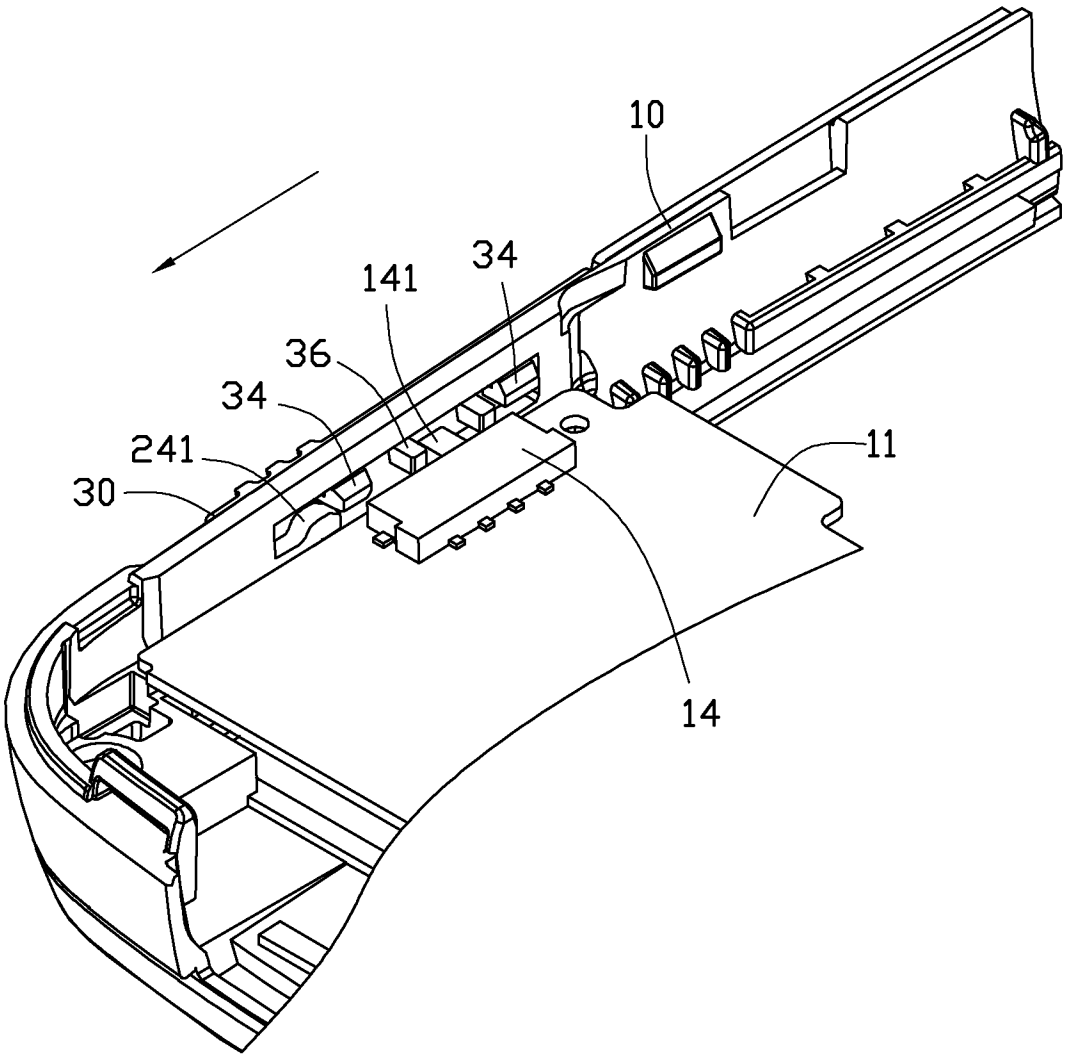
FIG. 5 is an assembled view of the portable electronic device shown in FIG. 1.
Figure 6:
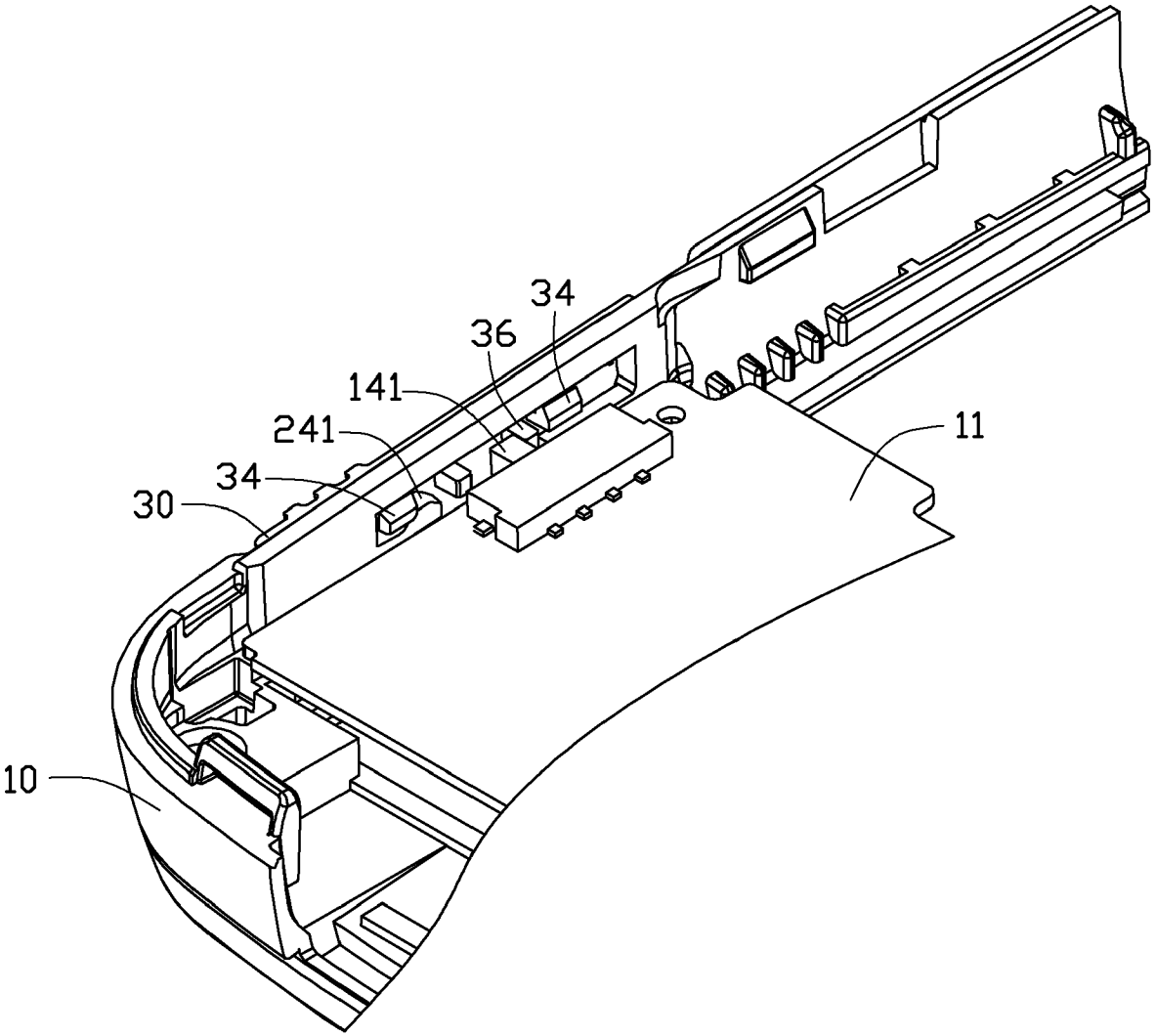
FIG. 6 is a state view of the portable electronic device shown in FIG. 1.

In use, the control key 30 is slid in the groove 21 along a direction indicated by the arrow in FIG. 5. Sliding the control key 30 detaches the arm 25 from one of the first hooks 33, and then latches one of the second hooks 34 in the first projection 241 of the arm 24. The movement of the control key 30 moves one of the blocks 36 to push the button 141 to switch to another function. Since the first hooks 33 and second hooks 34 are latched with the latching plates 222, 223, the control key 30 is slidable in the receiving groove 21 and operation of control key 30 is more stable. Additionally, the arms 24, 25 provide better engagement between the control key 30 and the housing 10.

It is to be understood, however, that even through numerous characteristics and advantages of the present disclosure have been set forth in the foregoing description, together with details of assembly and function, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A control key assembly for an electronic device, comprising:

a housing forming a receiving portion, the receiving portion defining an opening having two spaced-apart arms and forming two stopper plates and two latching plates around the opening; and a control key positioned in the receiving portion, the control key including a first hook and a second hook; wherein one of the latching plates slidably engages with the first hook and the other of the latching plates slidably engages with the second hook, the first hook and the second hook are slidably engaged in the opening, and alternatively latch with the two arms when the control key is slid between first and second positions.

2. The control key assembly as claimed in claim 1, wherein a first projection extends in a first direction from one of the arms, and a second projection extends in a second, opposite direction from the other of the arms.

3. The control key assembly as claimed in claim 1, wherein the control key includes a main portion and an operating portion, the operating portion integrally formed with the main portion.

4. The control key assembly as claimed in claim 1, further comprising an additional first hook, the first hooks formed on an inner surface of the main portion, the two first hooks are coaxial, and positioned adjacent to an edge of the control key.

5. The control key assembly as claimed in claim 4, further comprising an additional second hook, the second hooks formed on an inner surface of the main portion, the second hooks are coaxial, and positioned adjacent to another edge of the control key, opposite to the first hooks.

6. The control key assembly as claimed in claim 5, further comprising two blocks positioned between the first hooks.

7. An electronic device for controlling the electronic device, a housing forming a receiving portion defining an opening, each of two stopper plates formed at each of two opposite ends of the opening, a first arm extending from one of the two stopper plates along a first horizontal direction and a second arm extending from the other of the two stopper plate along a second horizontal direction reverse to the first horizontal direction;

a control key received in the receiving portion, the control key including a set of first hooks and a set of second hooks; wherein the sets of the first hooks and the second hooks are slidably engaged with the receiving portion, and alternatively latch with the first arm or the second arm when the control key is slid between first and second positions.

8. The electronic device as claimed in claim 7, wherein the first hooks are coaxial, and positioned adjacent to an edge of the control key.

9. The electronic device as claimed in claim 8, wherein the second hooks are coaxial, and positioned adjacent to another edge of the control key.

10. The electronic device as claimed in claim 9, wherein two blocks are positioned between the first hooks.

11. The electronic device as claimed in claim 7, wherein the receiving portion includes two latching plates formed at two opposite sides of the opening, the latching plates are stepped, and are slidably engaged with the first hook and the second hook.

12. The electronic device as claimed in claim 7, wherein a first projection extends in a first vertical direction from the first arm, and a second projection extends in a second, opposite vertical direction from the second arm.

13. An electronic device for controlling the electronic device, a housing forming a receiving portion, the receiving portion forming two arms;

a control key received in the receiving portion, the control key including a set of first hooks and a set of second hooks;

wherein the first hooks are coaxial, and positioned adjacent to an edge of the control key, the second hooks are coaxial, and positioned adjacent to another edge of the control key, the first hooks and the second hooks are slidably engaged with the receiving portion, and alternatively latch with the two arms when the control key is slid between first and second positions.

14. The electronic device as claimed in claim 13, wherein the receiving portion defines an opening having two stopper plates and two latching plates, the latching plates are stepped, and are slidably engaged with the first hook and the second hook.

* * * * *